US006305824B1

(12) United States Patent
Holten

(10) Patent No.: US 6,305,824 B1
(45) Date of Patent: Oct. 23, 2001

(54) LUMINAIRE WITH LAMELLAE HAVING A GRADUAL CHANGE IN THEIR PROFILES

(75) Inventor: Petrus A. J. Holten, Winterswijk (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/561,602

(22) Filed: Apr. 27, 2000

(30) Foreign Application Priority Data

Apr. 28, 1999 (EP) ..... 99201310

(51) Int. Cl.[7] ..... F21V 21/29

(52) U.S. Cl. ..... 362/290; 362/291; 362/342; 362/297

(58) Field of Search ..... 362/290, 291, 362/342, 297

(56) References Cited

U.S. PATENT DOCUMENTS 6,220,729 * 4/2001 Holten ..... 362/291

FOREIGN PATENT DOCUMENTS 0286890 10/1988 (EP) .

* cited by examiner

*Primary Examiner*—Thomas M. Sember
*Assistant Examiner*—Ali Alavi
(74) *Attorney, Agent, or Firm*—Dicran Halajian

(57) ABSTRACT

The luminaire comprises several flat, light-diffusing lamellae (10) between reflectors (1) which each comprise an edge (2) in a light emission window (3). Each lamella has lateral edges (100), an outer edge (12), an inner edge (11), and a relief (101). The relief (101) of the lamella (10) decreases in a direction towards the lateral edges (100), hence avoiding non-uniform light reflections (zebra patterns) of the lamellae (10) on the reflectors (1).

7 Claims, 4 Drawing Sheets

LUMINAIRE WITH LAMELLAE HAVING A GRADUAL CHANGE IN THEIR PROFILES

BACKGROUND OF THE INVENTION

The invention relates to a luminaire comprising:

reflectors which are situated mutually substantially parallel opposite one another and whose edges at one side define a light emission window;

means for holding an electric lamp between the reflectors;

a plurality of light-scattering lamellae between the reflectors, transverse to the reflectors and to the light emission window, which lamellae are provided each with a lateral edge, an inner edge, an outer edge in the light emission window, and a relief.

Such a luminaire is known from European patent EP 0 286 890 B1. The lamellae in the known luminaire have a relief of folds which extend along the outer edge and which have a profile depth. The profile depth in the known lamp is a level difference in the surface of the lamella which is obtained through deformation of the lamella surface. The folds comprise a portion facing the observer and a portion facing away from the observer, which portions have a comparatively high and a comparatively low brightness, respectively, during the operation of the accommodated lamp. The folds give the lamellae in general an average, comparatively low brightness as compared with non-undulated lamellae, which brightness in the case of non-undulated lamellae is often perceived as too high by the observer. Those portions of the folds which are situated adjacent the lateral edges of the lamellae lead to an image of the lamellae being projected on the reflectors in the form of a light spot with brightness differences. The brightness differences form a light-dark striped pattern. A disadvantage of the known luminaire is that the light spot with a light-dark pattern is visible to the observer during operation of the accommodated electric lamp.

SUMMARY OF THE INVENTION

It is an object of the invention to provide a luminaire of the kind described in the opening paragraph in which the image of the lamella surface in the form of a light spot with a light-dark pattern on the reflectors is reduced.

According to the invention, this object is achieved in that a luminaire of the kind described in the opening paragraph is characterized in that the lamella has a relief which decreases in the direction towards the lateral edge. The measure has a twofold effect. On the one hand, it is achieved thereby that brightness differences in the light-dark pattern resulting from the fact that the surface adjacent the lateral edges is not plane are reduced thanks to the reduced relief, and accordingly are imaged on the reflectors with smaller brightness differences. On the other hand, the brightness of the lamella surface is evened out thereby, since the decrease in brightness of this surface caused by an increasing distance of this surface to the electric lamp is compensated for by the profile which is reduced in the direction towards the lateral edge. The decreasing relief may be decreasing owing to a decreasing profile depth, or alternatively it may be decreasing in that the profile has a pattern which is repeated over an increasing distance each time, in which case the profile depth may be constant. The relief of the lamella may be built up from, for example, folds, but it may alternatively be designed as a sunken relief of, for example, pits or holes in the lamella.

In an embodiment, the luminaire is characterized in that the relief shows a decreasing trend in the direction towards the outer edge. A further equalization in the brightness of the lamellae from the inner edge to the outer edge is achieved thereby, so that also an equalization in the brightness of the image of the lamellae on the reflector is achieved.

In an alternative embodiment, the luminaire is characterized in that the relief is at least substantially absent at the lateral edge. This means that the lamella is at least substantially flat at the lateral edge of the lamella, so that brightness differences in the light-dark pattern adjacent the lateral edge of the lamella are yet further reduced. A further evening out of the image of the lamellae on the reflector is also achieved thereby.

In a further embodiment, the luminaire is characterized in that a decrease in the relief in a direction substantially parallel to the outer edge starts at a distance of 1 to 2 cm from the lateral edge. The reflectors are usually provided with a comparatively diffusely reflecting material, for example aluminum which may be frosted by anodization. The images of the lamellae become blurred owing to the diffuse reflective of the reflectors. Images of portions of the lamellae having a relief situated at a distance greater than 1 to 2 cm from the reflectors are accordingly no longer observable as images with light-dark patterns. A gradual change in the relief can accordingly remain limited to a portion of the lamella starting from 1 to 2 cm from the lateral edges. The gradual change may also be discontinuous and consist in that the relief has an abrupt transition from the relevant portion of the lamella to another portion of the lamella which is at least substantially without relief, i.e. the lamella in the other portion is at least substantially plane. The equalization of the lamella brightness is then indeed changed abruptly by the discontinuous change from a portion with relief to a portion with an at least substantially plane surface, but this is counterbalanced by the fact that brightness differences in the light-dark pattern in the image of the lamellae on the reflector are at least substantially prevented.

In a favorable embodiment, the luminaire is characterized in that the relief comprises folds which extend substantially parallel to the outer edge, or depressions and elevations. An attractive property of lamellae provided with reliefs in this manner is that they can be obtained in one operation, cut and profiled, during their manufacture from, for example, metal tape. A crest of a fold or a depression at the one surface of the lamella then is a valley or an elevation at the other surface of the lamella.

The luminaire according to the invention may be designed, for example, for accommodating a straight tubular electric lamp, for example a fluorescent lamp, such as a low-pressure mercury vapor discharge lamp. The luminaire may alternatively be designed for an elongate lamp in which, for example, two straight, interconnected tubular portions extend next to one another. Depending on the number of pairs of substantially parallel, mutually facing reflectors in the luminaire, a lamella may be subdivided into several sub-lamellae, which sub-lamellae will each have a change in their profiles analogous to that of a single (sub-)lamella. If the luminaire is at least substantially round or square, the lamellae may be provided crosswise in the light emission window. The luminaire may or may not have a housing in which the reflectors are accommodated. The lamellae may be manufactured by means of deformation of, for example, metal plating, but alternatively they may be manufactured by injection molding.

BRIEF DESCRIPTION OF THE DRAWINGS

Embodiments of the luminaire according to the invention are shown in the drawing, in which.

DETAILED DESCRIPTION OF THE PREFERRED EMBODIMENTS

Figure 1:
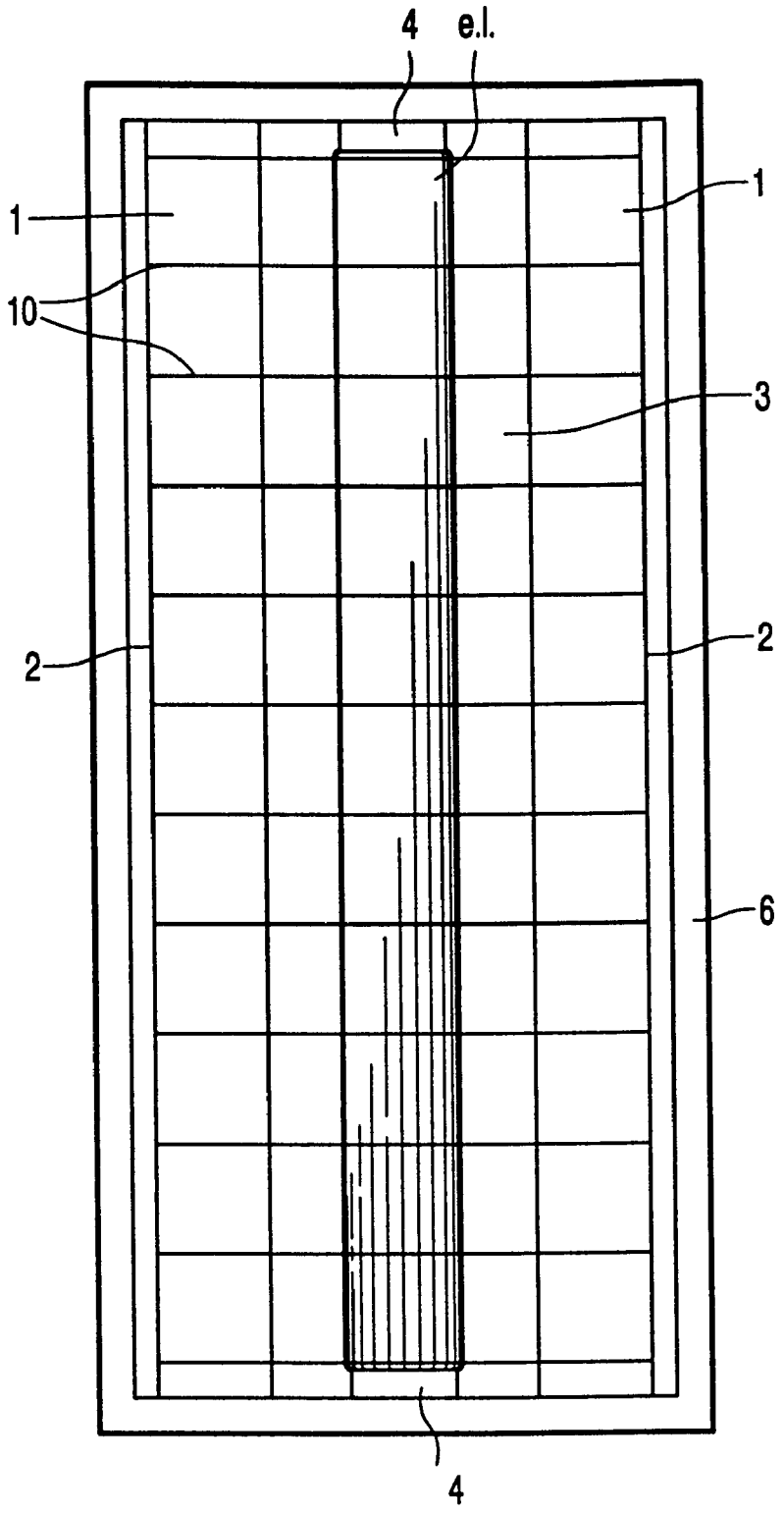
FIG. 1 is an elevation of the luminaire in which the light emission window is visible.
Figure 2:
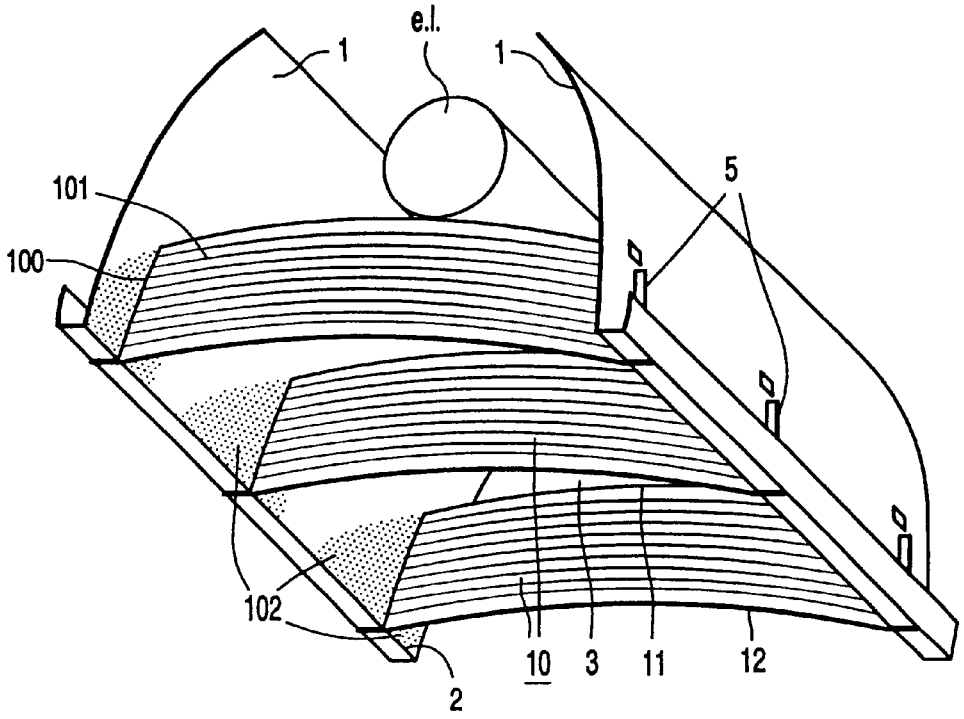
FIG. 2 shows part of the luminaire of FIG. 1 in perspective view, viewed in a plane which is oblique with respect to the lamp.

The luminaire of FIG. 1, see also FIG. 2, has elongate reflectors 1 which are concave in the Figure but which may alternatively be plane or faceted, which are positioned substantially mutually parallel opposite one another, and which each have an edge 2, said edges defining a light emission window 3. The reflectors 1 are accommodated in a housing 6 in FIG. 1. Means 4 are present for accommodating therein an elongate electric lamp e.1. between the reflectors. A plurality of flat, light-scattering lamellae 10 is accommodated between the reflectors 1, transverse to the reflectors 1 and transverse to the light emission window 3.

Figure 3:
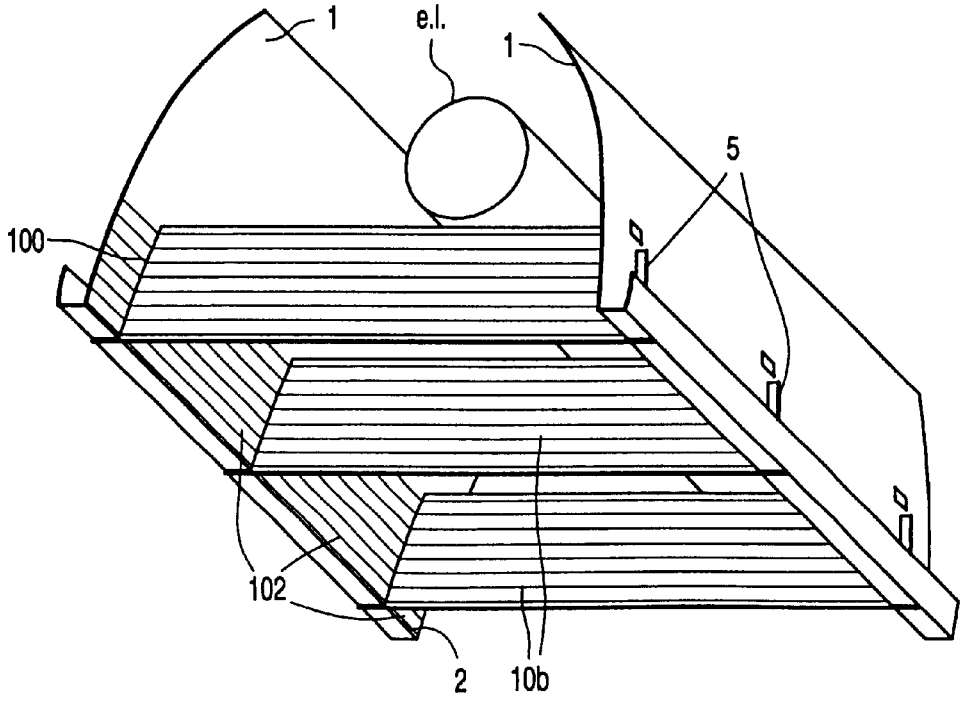
FIG. 3 shows part of a conventional luminaire in perspective view, seen in a plane which is oblique with respect to the lamp.

FIG. 2 shows the same luminaire in perspective view, viewed in a plane oblique with respect to the lamp. FIG. 2 shows how the lamellae 10 project through slots 5 in the reflectors 1 and are fixed therein. The lamellae 10 each have a convex inner edge 11 along, but at a distance from the light emission window, and a concave outer edge 12 in the light emission window 3. The lamellae 10 are provided with a relief 101 with a profile depth which decreases in a direction towards the lateral edge 100. In FIG. 2, the image 102 of the lamellae 10 projected on the reflectors 1 is a homogeneous light spot. In FIG. 3, however, with conventional lamellae 10*b* in the lamp having a relief 101 without a decreasing profile depth, the image 102 of the lamellae 10*b* projected on the reflectors 1 is a light spot with a light-dark striped pattern.

Figure 4:
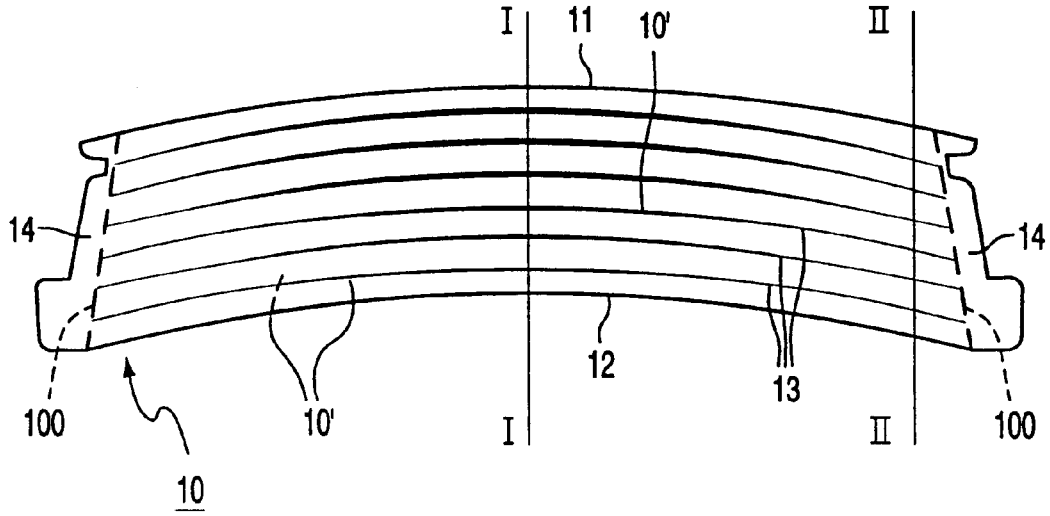
FIG. 4 is an elevation of a lamella having a relief according to the invention.

FIG. 4 shows a lamella 10, of curved shape in the Figure, but the lamella may also have a different shape, for example one with sub-lamellae. In FIG. 4, the lamellae 10 have surfaces 10' with folds 13 which have a profile depth and extend along the outer edge 12. The Figure indicates a change in the profile depth of the folds 13 over the surface 10' of the lamella 10 by means of a change in the thickness of the lines which represent the folds 13. A thick line indicates a great profile depth of the relevant fold 13. A thin line indicates a small profile depth of the relevant fold 13. The maximum level difference (or profile depth) in the folds 13 is approximately 0.5 mm. FIG. 4 further shows that the folds 13, i.e. the portions of the surfaces 10' provided with relief 101, extend exclusively between the lateral edges 100. Portions 14 of the lamellae 10 projecting into and through the slots 5 (see FIG. 2) are not undulated.

Figure 5:
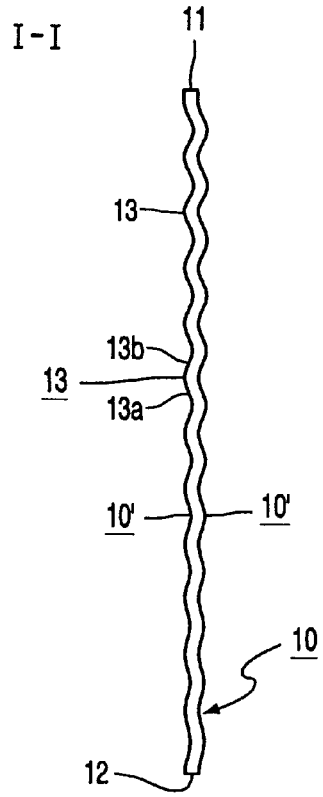
FIG. 5 is a cross-section taken on the line I—I in FIG. 4.
Figure 6:
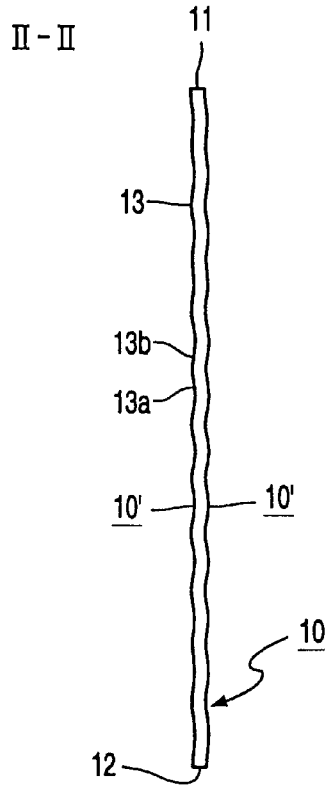
FIG. 6 is a cross-section taken on the line II—II in FIG. 4.

FIG. 5 shows a cross-section of the embodiment of the lamella 10 according to FIG. 4 taken on the line I—I. The profile depth in FIG. 5 decreases gradually from the inner edge 11 towards the outer edge 12 over the entire height of the lamella 10. The profile depth of the folds also decreases in a direction from the lateral edge 100 transversely to the lateral edge 100 (see FIG. 4). This decrease in the profile depth of the folds 13 in the direction of the lateral edge 100 is shown in FIG. 6, which is a cross-section taken on the line II—II through the lamella 10 at approximately 0.5 cm away from the lateral edge 100, in the embodiment of FIG. 4. It is evident here that the profile depth of the folds 13 is substantially smaller than the profile depth of the folds 13 in FIG. 5. This decrease in the profile depth of the folds 13 suppresses an imaging of the lamellae with a light-dark striped pattern on the reflectors at least substantially entirely. The folds 13 each have a portion 13*a* facing towards an observer below the Figure and a portion 13*b* facing away therefrom, which portions have a comparatively low and a comparatively high brightness, respectively, when an accommodated lamp is burning. The folds 13 give the lamellae 10 as a whole an average brightness which is comparatively low for an observer as compared with a non-undulated lamella. However, since the profile depth of the folds 13 decreases in a direction towards the outer edge 12 and because the profile depth of the folds also reduces in a direction towards the lateral edge 100 and transversely to the lateral edge 100, the brightness in a zone adjoining the inner edge 11 differs little, or not at all, from that at the outer edge 12.

What is claimed is:

1. A luminaire comprising:

reflectors (1) which are situated mutually substantially parallel opposite one another and whose edges (2) at one side define a light emission window (3);

means (4) for holding an electric lamp (e.l.) between the reflectors (1);

a plurality of light-scattering lamellae (10) between the reflectors (1), transverse to the reflectors (1) and to the light emission window (3), which lamellae (10) are provided each with a lateral edge (100), an inner edge (11), an outer edge (12) in the light emission window (3), and a relief (101), characterized in that the lamella (10) has a relief (101) which decreases in a direction towards the lateral edge (100).

2. A luminaire as claimed in claim 1, characterized in that the relief (101) which decreases in a direction towards the lateral edge (100) has a decreasing profile depth.

3. A luminaire as claimed in claim 1, characterized in that the relief (101) decreases in a direction towards the outer edge (12).

4. A luminaire as claimed in claim 1, characterized in that the relief (101) is at least substantially absent at the lateral edge (100).

5. A luminaire as claimed in claim 1, characterized in that a decrease in the relief (101) in a direction substantially parallel to the outer edge (12) starts at a distance of 1 to 2 cm from the lateral edge (100).

6. A luminaire as claimed in claim 1, characterized in that the relief (101) comprises folds (13) which extend substantially parallel to the outer edge (12).

7. A luminaire as claimed in claim 1, characterized in that the relief (101) comprises indentations and elevations.

* * * * *